US005626045A

United States Patent [19]

Bulle

[11] Patent Number: 5,626,045

[45] Date of Patent: May 6, 1997

[54] METAL STOCK BENDER

[76] Inventor: Marshall R. Bulle, P.O. Box 163, Centennial, Wyo. 82055

[21] Appl. No.: 490,568

[22] Filed: Jun. 15, 1995

Related U.S. Application Data

[63] Continuation-in-part of Ser. No. 232,389, Apr. 25, 1994, abandoned.

[51] Int. Cl.[6] ..... B21D 7/024

[52] U.S. Cl. ..... 72/219; 72/217; 72/321

[58] Field of Search ..... 72/217–219, 388, 72/387, 321, 320

[56] References Cited

U.S. PATENT DOCUMENTS

| | | | |
|---|---|---|---|
| 757,078 | 4/1904 | Wood . | |
| 928,616 | 7/1909 | O'Bleness . | |
| 1,040,745 | 10/1912 | Olson . | |
| 1,054,675 | 3/1913 | Coffman . | |
| 1,349,219 | 8/1920 | Moore et al. . | |
| 1,387,683 | 8/1921 | Bussel . | |
| 1,473,101 | 11/1923 | Hossfeld . | |
| 2,424,024 | 7/1947 | Garton | 153/2 |
| 2,656,872 | 10/1953 | Mann et al. | 153/46 |
| 2,701,001 | 2/1955 | James | 153/39 |
| 3,763,685 | 10/1973 | Fjellstrom | 72/217 |
| 3,861,186 | 1/1975 | Wigner, Jr. | 72/217 |
| 4,055,065 | 10/1977 | Whetstone, Jr. et al. | 72/217 |
| 4,282,737 | 8/1981 | Maples | 72/388 |
| 4,372,145 | 2/1983 | Giordano et al. | 72/387 |
| 4,785,650 | 11/1988 | Lusty | 72/217 |

FOREIGN PATENT DOCUMENTS

| | | |
|---|---|---|
| 1038403 | 9/1953 | France . |

*Primary Examiner*—Daniel C. Crane

*Attorney, Agent, or Firm*—Nawrocki, Rooney & Sivertson, P.A.

[57] ABSTRACT

A hand operated bending apparatus uses a lever arm which acts through a compound lever to increase the applied force. A pin, which mates with a number of holes at various distances along the compound lever linkage, permits changing the lever ratio readily. A bar extending outward from a forming die is slideably enclosed by a slide lock, which can wedge against the bar to lock the slide lock to the slide bar. The slide lock provides the pivot point for the operating lever arm to permit resetting the apparatus after a bend is made to allow bending metal stock by a number of successive steps with little time penalty.

14 Claims, 4 Drawing Sheets

METAL STOCK BENDER

This application is a continuation in part of U.S. Ser. No. 232,389, filed Apr. 25, 1994, now abandoned.

FIELD OF THE INVENTION

This invention relates to an apparatus for bending metal stock using manual power only.

BACKGROUND OF THE INVENTION

A variety of metal stock benders using manual power only are available which use a compound lever to increase the amount of power applied to bending the metal. Examples are J. Wood, U.S. Pat. No. 757,078; J. Garton, U.S. Pat. No. 2,424,024; H. M. James, U.S. Pat. No. 2,701,001 and B. Fjellstrom, U.S. Pat. No. 3,763,685.

None of these patents address the problem presented when a compound lever arrangement is used to increase the amount of power applied, namely the corresponding reduction in bending range as the leverage is increased, which is directly proportional to the increase in power obtained by the compound lever.

An additional problem not addressed is means for changing the bend radius and shape readily.

SUMMARY OF THE INVENTION

The instant invention uses an operating lever to force a roller die around a forming die to bend metal stock located between the two. The operating lever acts through a compound lever arrangement to increase the amount of power available. This power increase is very desirable in that it permits the use of inexpensive and safe manual equipment for heavy metal stock that could not otherwise be bent by hand, rather than the expensive and potentially dangerous power driven equipment usually required. However, as discussed earlier, there is a trade-off in a reduction in the amount of bending provided by the use of a compound lever that corresponds directly to this increase in force.

This invention addresses the problem of this reduction in the amount of bending in two ways. First, a number of linkage points for a variety of compound lever ratios are selected by merely inserting pins through one of a number of holes at different points along the compound lever linkage. this provides a quick and easy means to easily change the compound lever ratio and allows the operator to select a lever ratio which will provide only as much force as is necessary for him to bend a particular metal stock. A minimum force uses a minimum lever ratio which results in a maximum bending range.

Second, a simple and quick means of changing the bending initiation point is provided. this permits using several successive bends to accomplish a large bend angle in a minimum amount of time. this effectively overcomes the time disadvantage if several bending steps are required. This is accomplished by changing the distance between the operating lever pivot point and the forming die. A slide bar attached to the forming die extends past the operating lever pivot point. A slide lock, which can either slide over the slide bar or be locked to *the slide bar, contains the pivot point for the operating lever.

The locking action is provided by the inclination of the slide lock with respect to the slide bar. The slide lock consists of two slide lock plates which are separated enough to slideably enclose the slide bar. A pair of bolts attach these plates together along one side of the slide bar, while a single bolt attaches the plates together along the opposite side of the slide bar. The bolts are arranged such that the slide lock bolts along one side can be inclined slightly with respect to the slide bar, and such that the slide lock can slide readily over the slide bar when these two bolts are parallel to the slide bar, but when these two bolts are inclined slightly one of those two bolts and the bolt on the opposite side will jam into the slide bar and lock the two together. A second embodiment of this lock has a plurality of spaced apart notches along one side of the slide bar which the slide lock bolt engages.

A slide lock lever attached to one of the slide lock plates permits manual cocking or uncocking of the slide lock with respect to the slide bar to lock or unlock the two parts.

As mentioned, the slide lock contains the pivot point for the operating lever. Using the slide lock to change the position of the operating lever's pivot point provides a quick and easy means to change the location of the operating lever pivot point and to reset the apparatus for subsequent bends of the same stock.

To perform a bend, the stock is mounted in the bender with the portion to be bent located between the forming die and the roller die, with the slide lock unlocked to slide freely over the slide bar, the operating lever is fully extended and the slide lock is then locked to the slide bar by cocking it using the slide lock lever. The operating lever is then retracted to make a bend in the stock. If the resulting bend is less than the amount required, the slide lock is released using the slide lock lever, the operating lever is again fully extended, the slide lock is relocked to the slide bar using the slide lock lever, and the operating lever retracted to make another bend. This process can be repeated rapidly until the resulting bend is the required amount.

Each of the above improvements address and reduce the problem presented by the inevitable trade-off in the reduction of bending range when a compound lever is used to increase bending power.

In addition to the above improvements, which are directed to problems created by the use of a compound lever, the instant invention also provides a simple means to substitute for both the forming die and the roller die used for different diameter bends.

DETAILED DESCRIPTION OF THE PREFERRED EMBODIMENT

Figure 6:
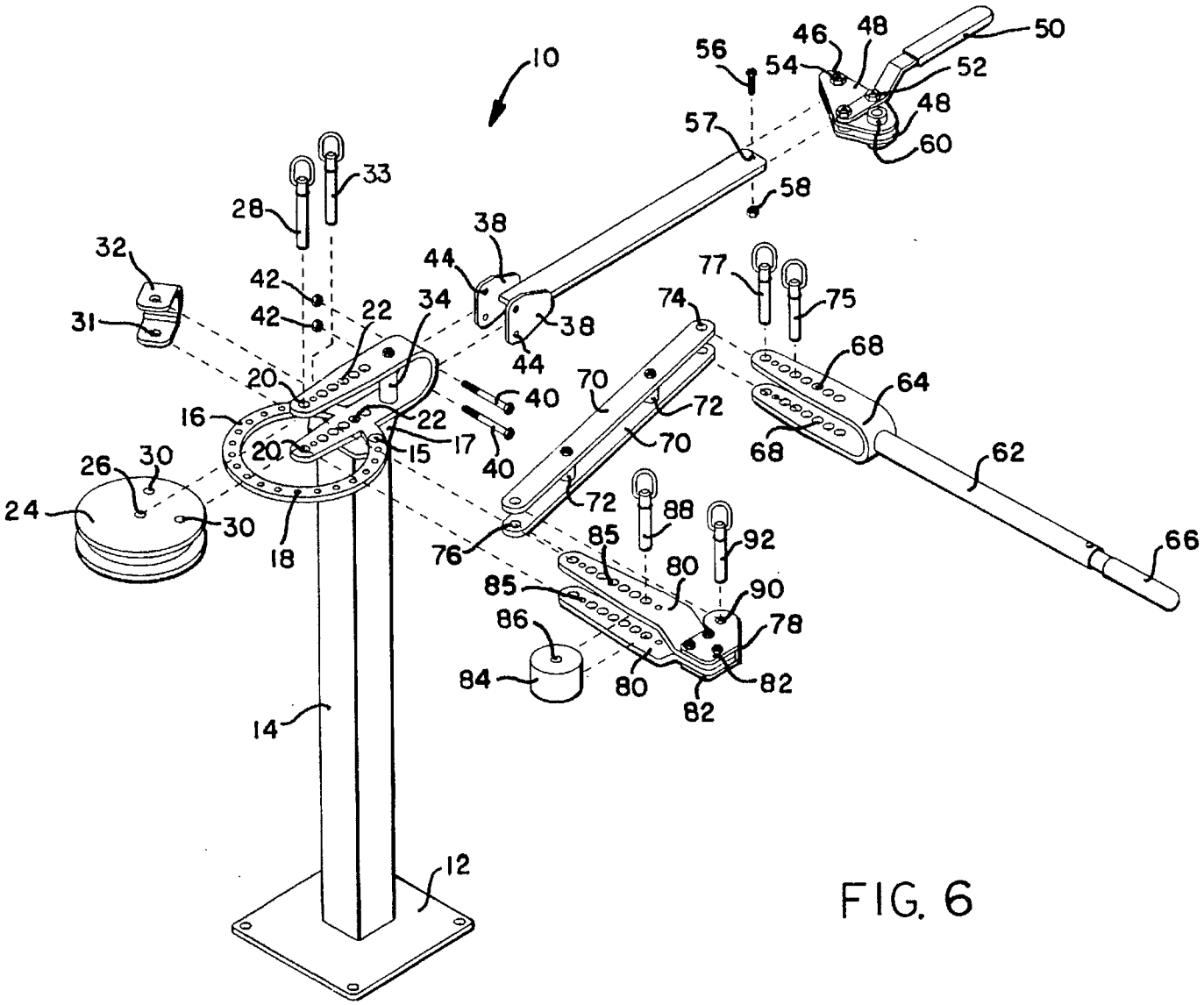
FIG. 6 is a perspective exploded view of the apparatus.

Referring to FIG. 6, an exploded view of bender 10 is shown. Bender 10 has a base 12 secured to the floor, upon which is mounted a supporting pedestal 14. U-shaped forming die holder 16 is mounted upon generally triangular shaped bracket 17 and both are secured to the top of pedestal 14 by two bolts 15. The top of bolts 15 are recessed within forming die holder 16 and he opposite ends secured on the underside of bracket 17 using mating nuts.

Forming die holder 16 is formed from a single sheet of metal which is blanked to the shape shown, the various holes are then stamped and the result is bent to the shape shown. The lower outer portion of forming die holder 16 is circular in shape with a number of stop holes 18 about the periphery. Stop holes 18 provide a means to secure an end stop of predetermine the amount of ben in the object operated upon. Opposed centered holes 20 provide pivot point which will be discussed later. A number of pairs of beginning stop holes 22, which are opposite each other extending outward from center hole 20, provide a means for predetermining the starting point of the bend. stop holes 22 at various distances from center holes 20 provide a means to secure a variety of accessory shapes such as a block, not shown, if any are desired. A stop block bearing against one end of the object being bent can provide a right angle bane rather than simply a curved shape.

A forming die 24 with a center hole 26 is secured within U-shaped forming die holder 16 by center pin 28 which extends through center holes 20 in U-shaped forming die holder 16 and also through center hole 26. This permits changing a forming die 24 readily to substitute a different type die. Forming dies 24 having different diameters are used to provide different radii bends. Clamp holes, 30 having mounting holes 31, provide a means to mount tube clamp 32, which is mounted over a pipe to be bent, which is placed within forming die 24 using clamp pin 33, which mates with holes 30 and 31 to hold the pipe securely in place. The forming die 24 shown here has a groove with a semi-circular shape about its periphery to accommodate a pipe, however the surface can be flat rather than semi-circular in shape in order to accommodate flat stock for bending.

A cylindrical shaped spacer 34 is mounted between arms of forming die holder 16 and is secured in place by a bolt through mating aligned holes in the arms, which also extend through the spacer, which is secured in place by a mating nut.

Slide bar 36 is secured to two opposed side plates 38. slide bar is secured to forming die holder 16 by bolts 40 secured by nuts 42. Bolts 40 extend through aligned mating holes 44 in side plates 38 and bear against spacer 34. Slide lock 46 is made up of two identical slide lock plates 48, which are spaced apart enough to slideably enclose slide bar 36. Slide lock lever 50 is mounted on slide lock 46. Slide lock plates 48 are held together on one side of slide bar 36 along with slide lock lever 50 by bolts 51 and 52. slide lock plates 48 are held together on the opposite side of slide bar 36 by bolt 54. Bolts 51, 52 and 54 extend through aligned mating holes in plates 48 and in lever 50, and are secured in place by mating nuts. slide lock 46 is placed over slide bar 36 and prevented from sliding off of the far end of the bar by stop bolt 56 extending through a matching hole 57 in the end of the bar, which is secured by a mating nut 58. A solid bearing 60 extends through mating aligned holes in both side plates 48.

Operating lever 62 has a bifurcated and 64 opposite a handle 66. Bifurcated end 64 has two sets of opposed aligned holes 68 at different distances from handle 66.

Push bars 70 are held spaced apart by two cylindrical shaped push bar spacers 72. Spacers 72 are secured in place by bolts extending through aligned mating holes in spacers 72 and push bars 70, which are secured by nuts. Space bars 70 have equal size opposed aligned holes 74 and 76 on opposite ends.

Space bars 75 are spaced such as to fit within bifurcated end 64 of actuating lever 62 and are pivotally secured in place by pin 75 extending through an aligned pair of holes 68 in bifurcated end 64, excepting for the outer pair of holes, and through the aligned holes 74 in push bars 70. Bearing 60 has a length which will fit between the bifurcated end 64 of operating lever 62 with the same size interior opening as holes 68. Bearing 60, and slide lock 46 are pivotally held in place within bifurcated end 64 by pin 77, which is sized to fit and extends through the outermost aligned holes 68 of he bifurcated end of operating lever 62 and the bearing.

Roller die holder 78 consists of two inner opposed arms 80 and two outer end caps 82. Arms 80 have sets of opposed aligned holes 8 extending along their length being bent outwardly immediately adjacent to end caps 82 and then being bent parallel to one another far enough apart to accommodate roller die 84. Roller die 84 has a central hole 86, which is the same size as holes 85, being sized to accept pin 88 which secures the die pivotably in place. This permits changing roller die 84 readily to substitute a different type die. Note that the end holes 85 of arms 80 are not used for this purpose. End caps 82 have an extension which contains aligned holes 90 sized to accept pin 92. Push bars 70 also fit within the extensions of end caps 82 and are pivotally held in place there by pin 92 extending through upper end cap 82 hole 90, thence through push bar 70 aligned holes 76 and finally through lower end cap 82 hole 90.

Arms 80 of roller die holder 78 are also sized to fit around forming die 24, and the end holes 85 of the arms are sized to receive pin 28 and secure it pivotally in place about forming die 24.

Figure 1:
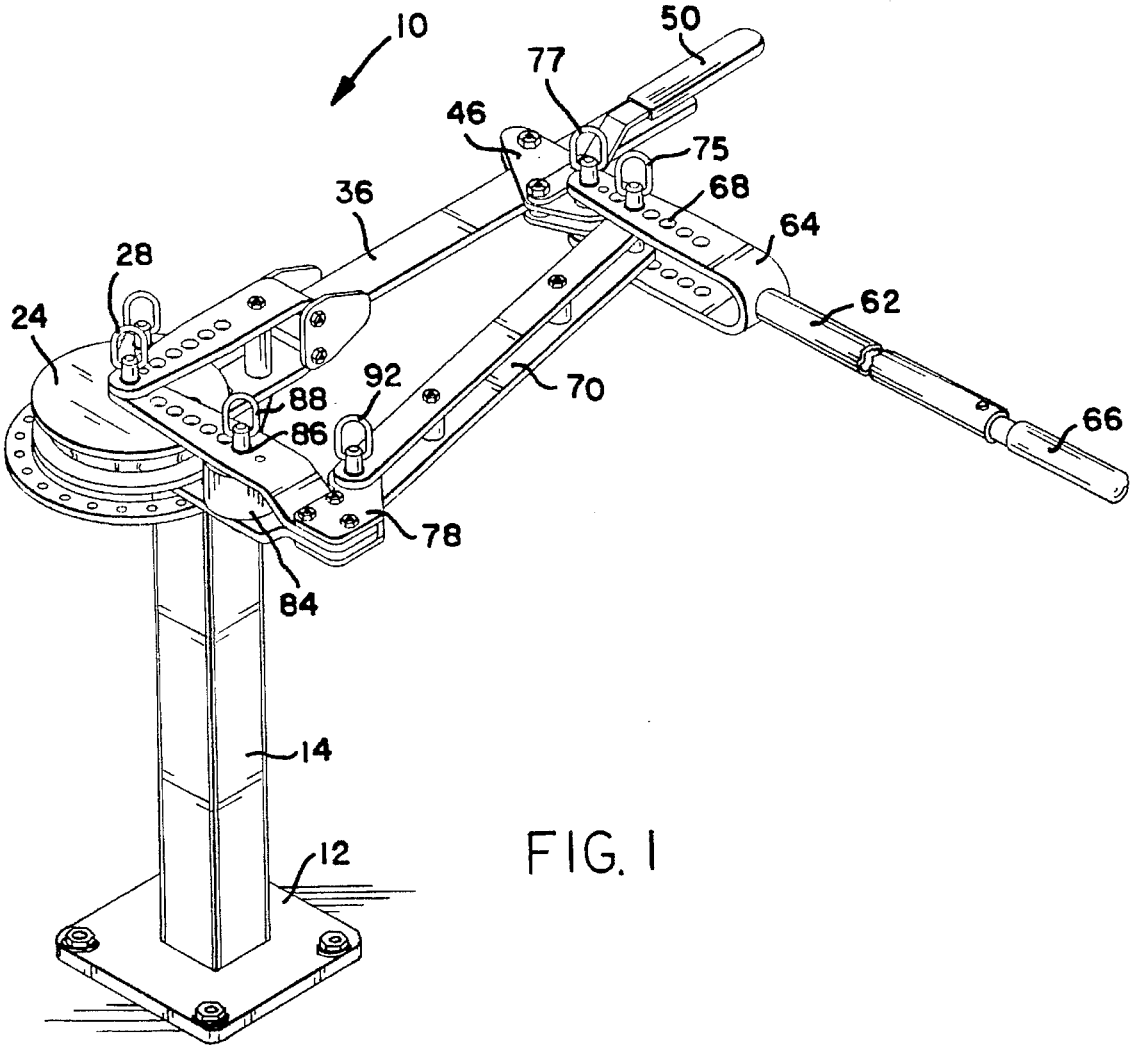
FIG. 1 is a perspective view of the assembled apparatus.
Figure 2:
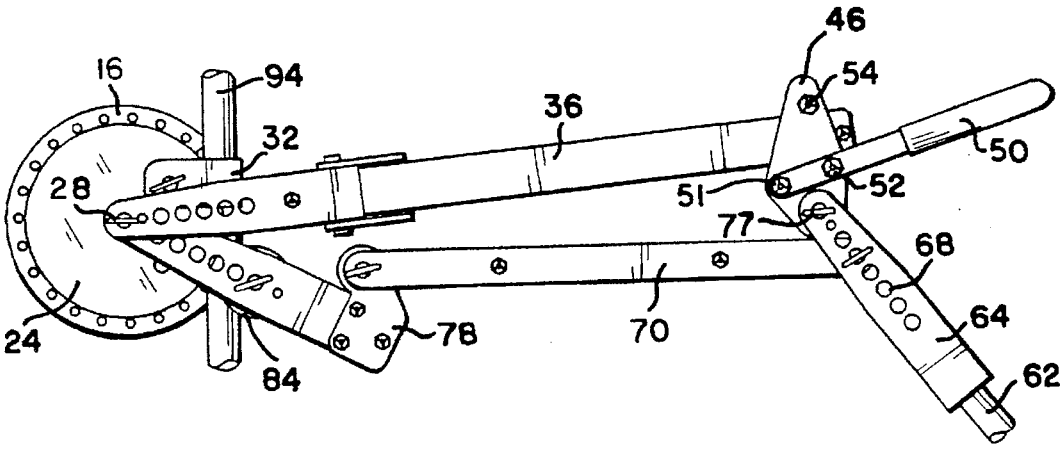
FIG. 2 is a top view of the operating elements of the apparatus positioned to bend a rod.
Figure 3:
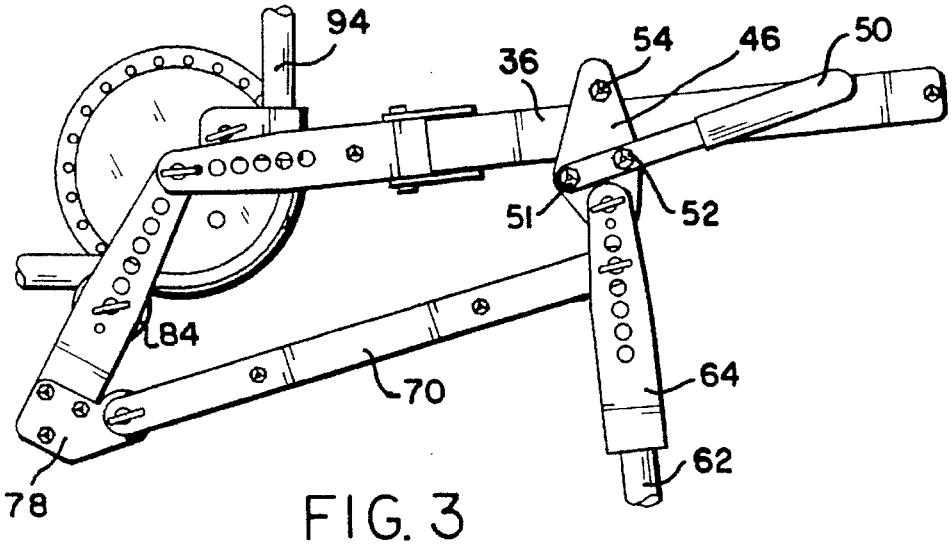
FIG. 3 is the view of FIG. 2 after the rod has been bent.
Figure 4:
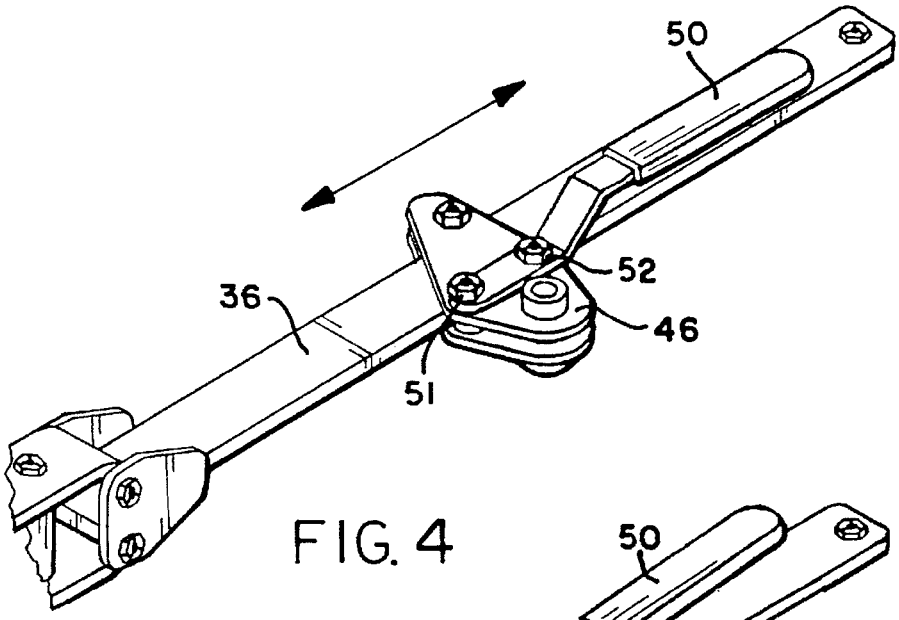
FIG. 4 is a perspective view of the unlocked position of the slide lock with respect to the slide bar.
Figure 5:
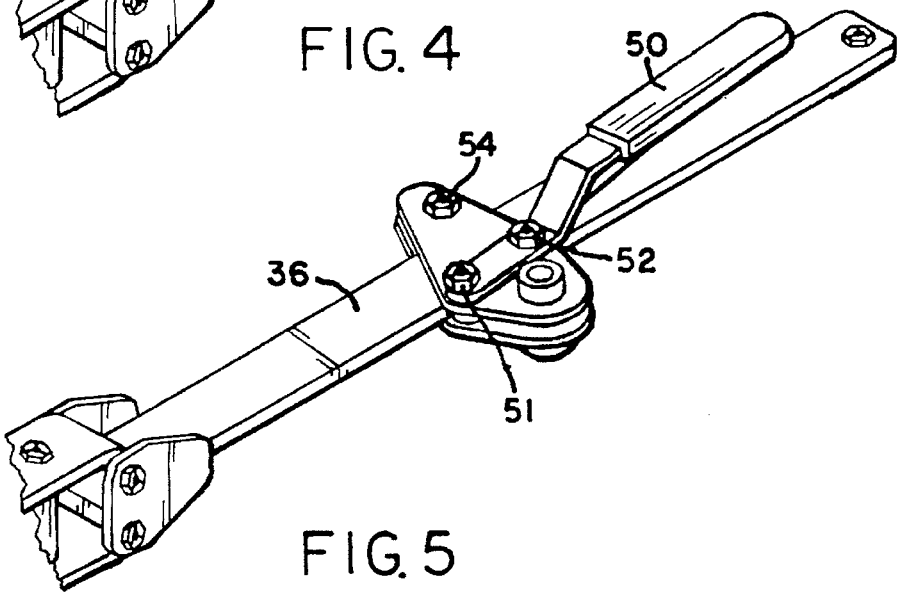
FIG. 5 is the view of FIG. 4 with the slide lock in the locked position.
Figure 7:
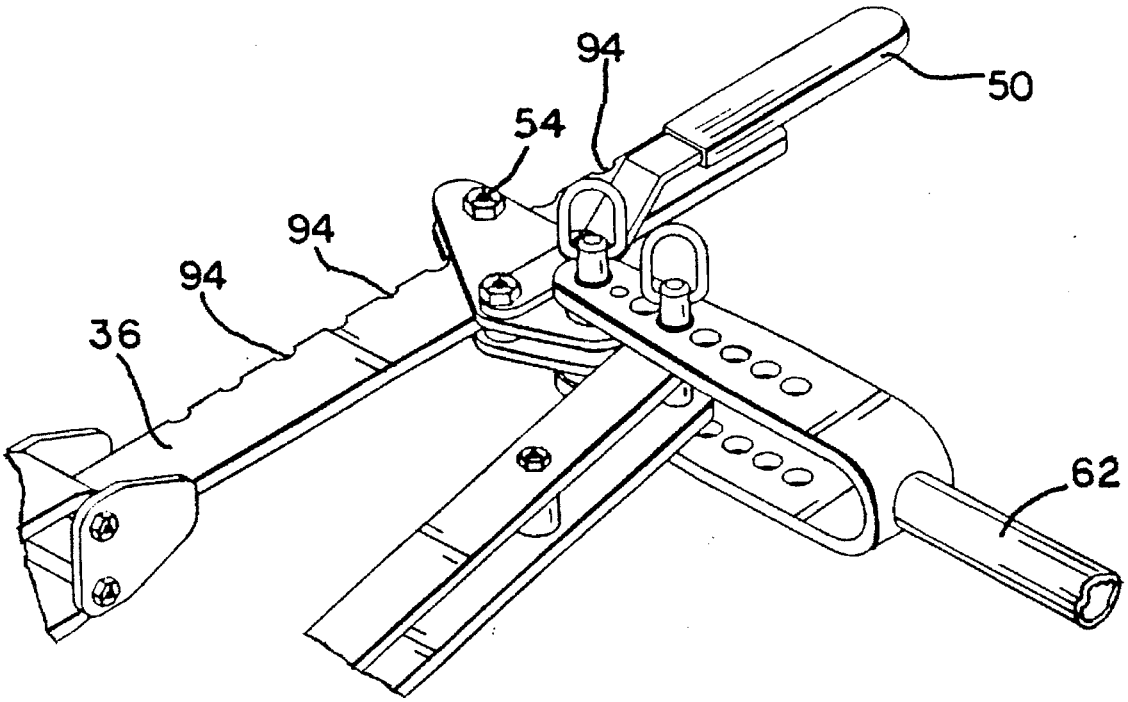
FIG. 7 is a perspective view of the second embodiment of the invention showing the unlocked position of the slide lock with respect to the slid bar.

This description covers only the physical structure of bender 10. FIGS. 1 through 3 are used to describe the operation of bender 10, and FIGS. 4, 5 and 7 are used to describe the operation of slide lock 46.

In FIG. 1, bender 10 is shown assembled. FIG. 2 shows the bender 10 before a bend is initiated, and FIG. 3 shows the bender at the conclusion of a bend. The diameter of forming die 24 will determine the radius of stock to be bent. The particular hole 68 selected to receive pin 75 will determine the leverage of the compound lever. In this arrangement slide bar 36 forms the fixed portion of the compound lever which pulls against center pin 28 thence against forming die 24. Operating lever 62 acts through pin 68 on push bars 70 to roller die holder 78 which forces roller die 84 against forming die 24. The particular hole 85 selected to receive pin 88 will depend upon the size of roller die 84 and forming die 24. This shows how simply the leverage ration can be changed by merely moving pin 75 to different aligned holes 68 in bifurcated end 64 of lever arm 62. the use of pins 28 and 88 likewise permit the ready substitution of different diameter forming dies 24 and roller dies 84 respectively. As discussed earlier, while a pipe is illustrated being bent here, merely by changing the surface of forming die 24 to one with a flat surface, the forming die will accommodate flat stock.

In FIG. 2, tube 94 is shown held in place by tube clamp 32 adjacent to forming die 24. slide lock lever 50 is inclined inward to slide bar 36 which inclines slide lock 46 with respect to the slide bar causing bolt 52 and 54 to jam against the bar. This will lock slide lock 46 with respect to slide bar 36. Operating lever is extended in the position ready to initiate bending.

In FIG. 3, operating arm 62 has been retracted to the left, which forces push bars 70 against roller die holder, which in turn causes roller die 84 to bend tube 94 approximately ninety degrees. Note that slide lock lever 50 is still inclined inward locking slide lock 46 against slide bar 36. In this example if a 180 degree bend were desired, slide lock lever 50 would be moved parallel to slide bar 36 to unlock the two, operating lever 62 would be extended to the orientation of FIG. 2, the slide lock lever would again be moved to the position shown in FIG. 3, and the bending cycle would be repeated.

For clarity, FIG. 4, illustrates the unlocked position of slide lock 46 with respect to slide bar 36 while FIG. 5 illustrates the locked position of the slide lock to the slide bar.

FIG. 7 illustrates a second version of the apparatus, where slide bar 36 contains a number of identical notches 94, which are equally spaced along one edge. Notches 94 provide a recess for bolt 54 when the slide lock is engaged as in FIG. 5. When the slide lock is engaged, notches 94 receive bolt 54 which greatly increases the holding power of the lock since the bolt must now be forced out of the notch to move slide lock 46 with respect to slide bar 36. Previously, only the friction between bolt 54 and the edge of slide bar 36 had to be overcome to move slide lock 46 with respect to the slide bar.

In this preferred embodiment all the parts, with the exception of the handle, are formed of steel, and all the jointing of parts, excepting where they are joined by nuts and bolts as indicated, is by welding. Any material having similar strength and rigidity and any joining means having similar strength can be substituted with identical result.

This invention retains the advantages of a compound lever in that it provides large forces by multiplying the initial force applied manually, but minimizes or eliminates the resulting disadvantages. In addition, either the forming or the roller die can readily be changed to accommodate different radius size or shape requirements.

While this invention has been described with respect to specific embodiments, these description are not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. Apparatus for manual bending of metal stock comprising:

a) pedestal means for support;

b) forming die means pivotably mounted upon said pedestal means for providing a predetermined metal stock shape;

c) roller die holder means pivotally mounted upon said pedestal means coaxial with said forming die means, said roller die holder means having roller die means pivotally mounted thereupon with the roller die holder being oriented to rotate said roller die means around said forming die means, arranged such that said roller die means will bend any metal stock placed between said roller die means and said forming die means to the shape of said forming die means;

d) compound lever means for rotating said roller die holder means around said forming die means, said compound lever means having a pivot point offset from said forming die means, said compound lever means further having slide bar means for slidably changing the position of the pivot point with respect to said forming die means, said slide bar means having lever operated locking means for securing the pivot point position of the compound lever means.

2. Apparatus as in claim 1 wherein said compound lever means has means for changing the lever ratio thereof.

3. Apparatus as in claim 1 having means for replacing said forming die means.

4. Apparatus as in claim 1 having means for replacing said roller die means, and having means for changing the location of said roller die means on said roller die holder means.

5. Apparatus as in claim 1 further comprising:

a) a first pin;

b) a generally U-shaped forming die holder having opposed arms, the outer ends of said arms having aligned holes therethrough, said forming die holder being attached to the second end of said pedestal with the aligned holes generally aligned with said pedestal;

c) a forming die having a hole therethrough, said forming die being pivotally attached between the arms of said forming die holder by said first pin extending through the aligned holes in said arms and the hole in said forming die.

6. Apparatus as in claim 5 wherein said roller die holder means comprises first and second arms, each arm having a first and a second end, the first and second ends being aligned respectively, the first and second arms being bent such that a portion from the first end to near the second end has spaced apart parallel arms, with the second ends being bent inwardly then parallel to the spaced apart portion such that the second ends are centered, the second ends being attached together, each arm having a plurality of holes of identical size at different locations along the spaced apart portion with each hole in the first arm aligned with a hole in the second arm and with the second end of said arms having a hole therethrough where attached together, the first end of said arms being pivotably attached between the arms of said forming die holder and around said forming die by the first pin extending through the aligned holes in the spaced apart portion which are nearest the first end of said first and second arms.

7. Apparatus as in claim 6 wherein said roller die means comprises a second pin and a roller die having a centered hole therethrough, said roller die being pivotably attached between said first and second arms of said roller die holder along the spaced apart portion by the second pin through any selected aligned holes therethrough excepting only the aligned holes nearest the first end thereof and through the centered hole in said roller die.

8. Apparatus as in claim 7 wherein said slide bar is attached to the forming die holder at the end opposite the arms, extending outwardly therefrom in the plane of said forming die, said slide bar having a generally rectangular shaped cross-section with the smallest dimension having a first and opposing second edge on opposite sides, said edges being generally parallel to said first pin.

9. Apparatus as in claim 8 wherein said slide means comprises identical shaped first and second slide plates, each slide plate having a first, second, third and fourth hole at identical locations therethrough, with said slide means further having a first, second and third bolt, each bolt having a matching nut, said plates being attached to opposite sides of said slide bar by the first and second bolts and matching nuts through aligned and mating first and second holes located adjacent to the first edge of said slide bar with the first hole being closest to the pedestal, and by the third bold and matching nut through aligned mating third holes located adjacent to the second edge of said slide bar, said first, second and third holes being arranged such that when said plates are aligned with the first and second bolts the same distance from the first edge of said slide bar the slide plates can move freely along said bar, but when the plates are skewed such that the second bolt digs into the first edge of the slide bar the plates will be locked with respect to the slide bar, the fourth holes being positioned further outward from the first edge of said slide bar than the first and second holes.

10. Apparatus as in claim 9 wherein said slide bar has a plurality of identical spaced apart notches along the first edge thereof each said notch being sized to receive said second bolt and lock said plates to said slide bar.

11. Apparatus as in claim 9 wherein the slide plate locking means comprises a locking lever having a pair of holes near one end generally aligned with the center of said lever and spaced apart the same as the first and second holes in said slide plates, said locking lever being secured to said slide plates by the first and second bolts.

12. Apparatus for manual bending of metal stock comprising:

a) pedestal means for support;

b) forming die means pivotably mounted upon said pedestal means for providing a predetermined metal stock shape; said apparatus having means for replacing said forming die means;

c) roller die holder means pivotally mounted upon said pedestal means coaxial with said forming die means, said roller die holder means having roller die means pivotally mounted thereupon with the roller die holder being oriented to rotate said roller die means around said forming die means, arranged such that said roller die means will bend any metal stock placed between said roller die means and said forming die means to the shape of said forming die means; said roller die holder means having means for replacing said roller die means, and having means for changing the location of said roller die means on said roller die holder means; said forming die holder further comprising a first pin, opposed arms with the outer ends of said arms having aligned holes therethrough, said forming die holder being attached to the outer end of said pedestal means with the aligned holes generally aligned therewith; said forming die having a hole therethrough and being pivotally attached between the arms of said forming die holder by said first pin extending through the aligned holes in said arms and the hole in said forming die;

d) compound lever means for rotating said roller die holder means around said forming die means, said compound lever means having means for changing the lever ratio thereof, and having a pivot point offset from said forming die means, said compound lever means further having slide bar means for changing the position of the pivot point with respect to said forming die means, said slide bar means having lever operated locking means for securing the pivot point position;

e) said roller die holder means comprising first and second arms, each arm having a first and a second end, the first and second ends being aligned respectively, the first and second arms being bent such that a portion from the first end to near the second end has spaced apart parallel arms, with the second ends being bent inwardly then parallel to the spaced apart portion such that the second ends are centered, the second ends being attached together, each arm having a plurality of holes of identical size at different locations along the spaced apart portion with each hole in the first arm aligned with a hole in the second arm and with the second end of said arms having a hole therethrough where attached together, the first end of said arms being pivotably attached between the arms of said forming die holder and around said forming die by the first pin extending through the aligned holes in the spaced apart portion which are nearest the first end of said first and second arms;

f) said roller die means comprising a second pin and a roller die having a centered hole therethrough, said roller die being pivotably attached between said first and second arms of said roller die holder along the spaced apart portion by the second pin through any selected aligned holes therethrough excepting only the aligned holes nearest the first end thereof and through the centered hole in said roller die;

g) said slide bar being attached to said forming die holder at the end opposite the arms, extending outwardly therefrom in the plane of said forming die, said slide bar having a generally rectangular shaped cross-section with the smallest dimension having a first and opposing second edge on opposite sides, said edges being generally parallel to said first pin; and h) said slide bar comprising identical shaped first and second slide plates, each slide plate having a first, second, third and fourth hole at identical locations therethrough, with said slide means further having a first, second and third bolt, each bolt having a matching nut, said plates being attached to opposite sides of said slide bar by the first and second bolts and matching nuts through aligned and mating first and second holes located adjacent to the first edge of said slide bar with the first hole being closest to the pedestal, and by the third bold and matching nut through aligned mating third holes located adjacent to the second edge os said slide bar, said first, second and third holes being arranged such that when said plates are aligned with the first and second bolts the same distance from the first edge of said slide bar the slide plates can move freely along said bar, but when the plates are skewed such that the second bolt digs into the first edge of the slide bar the plates will be locked with respect to the slide bar, the fourth holes being positioned further outward from the first edge of said slide bar than the first and second holes.

13. Apparatus as in claim 12 wherein said slide bar has a plurality of identical spaced apart notches along the first edge thereof each said notch being sized to receive said second bolt and lock said plates to said slide bar.

14. Apparatus as in claim 12 wherein the slide plate locking means comprises a locking lever having a pair of holes near one end generally aligned with the center of said lever and spaced apart the same as the first and second holes in said slide plates, said locking lever being secured to said slide plates by the first and second bolts.

* * * * *